United States Patent [19]

Czarnecki

[11] Patent Number: 4,742,930

[45] Date of Patent: May 10, 1988

[54] CLOSURE FOR CONTAINERS

[75] Inventor: John Czarnecki, Langho, England

[73] Assignee: Decorpart Limited, Nelson, England

[21] Appl. No.: 23,225

[22] Filed: Mar. 9, 1987

[30] Foreign Application Priority Data

Feb. 26, 1987 [GB] United Kingdom ..... 8704568

[51] Int. Cl.[4] ..... B65D 41/04

[52] U.S. Cl. ..... 215/334

[58] Field of Search ..... 215/334; 220/288

[56] References Cited

U.S. PATENT DOCUMENTS

| | | | |
|---|---|---|---|
| 2,133,298 | 10/1938 | Kaufman . | |
| 2,233,105 | 2/1941 | McCombs | 215/334 |
| 2,462,010 | 2/1949 | Spender | 215/334 |
| 3,249,248 | 5/1966 | Metzendorf | 215/334 |
| 4,011,962 | 3/1977 | Favell | 215/334 |

FOREIGN PATENT DOCUMENTS

| | | | |
|---|---|---|---|
| 2722371 | 5/1980 | Fed. Rep. of Germany . | |
| 792086 | 3/1958 | United Kingdom . | |
| 836683 | 6/1960 | United Kingdom . | |
| 1277369 | 6/1972 | United Kingdom . | |
| 1277274 | 6/1972 | United Kingdom . | |
| 1434970 | 5/1976 | United Kingdom | 06001972/GBX |
| 1551555 | 8/1979 | United Kingdom . | |

*Primary Examiner*—Donald F. Nortan

*Attorney, Agent, or Firm*—William R. Hinds

[57] ABSTRACT

A closure for a container comprises an outer part having a top wall and a depending peripheral skirt having inner, and outer surfaces, an inner part having a top wall and a depending peripheral skirt having inner and outer surfaces, the inner surface of the skirt of the inner part having means for attachment to a container, and a support element between the top walls resisting axial movement of the inner part top wall towards the outer part top wall. Adhesive may connect the top wall of the inner part to the support element which may have a domed central region receiving the adhesive. The peripheral region of the support element may be connected to the skirt of the outer part to resist rotation e.g. by adhesive. The inner part may be a push-fit in a folded-in bottom edge of the skirt of the outer part.

9 Claims, 1 Drawing Sheet

CLOSURE FOR CONTAINERS

This invention relates to closures for containers.

According to this invention a closure for a container comprises an outer part having a top wall and a depending peripheral skirt having inner and outer surfaces, an inner part having a top wall and a depending peripheral skirt having inner and outer surfaces, the inner surface of the skirt of the inner part having means for attachment to a container, and a support element between the top walls resisting movement of the inner part top wall towards the outer part top wall.

The support element may be connected by adhesive to the top wall of the inner part.

A central region of the support element may be domed to receive the adhesive.

The outer surface of the skirt of the inner part may be connected by adhesive to the inner surface of the skirt of the outer part.

Means may be provided for connecting the peripheral region of the support element to the outer part to resist rotation of the element relative to the outer part. Said means may be adhesive.

The adhesive on the inner surface of the skirt of the outer part may connect the inner part and the peripheral region of the support element.

The bottom edge of the skirt of the outer part may be folded in to provide a region of increased skirt thickness, the inner part being a push fit in the region of increased skirt thickness.

Also in accordance with the invention, there is provided a closure for a container comprising an outer part having a top wall and a depending peripheral skirt having inner and outer surfaces, an inner part having a top wall and a depending peripheral skirt having inner and outer surfaces, the inner surface of the skirt of the inner part having means for attachment to a container, and a separately formed support element between the top walls spacing the walls from each other so as to leave open spaces therebetween and resisting axial movement of the inner part top wall towards the outer part top wall.

The invention also provides a closure for a container comprising an outer part having a top wall and a depending peripheral skirt having inner and outer surfaces, an inner part having a top wall and a depending peripheral skirt having inner and outer surfaces, the inner surface of the skirt of the inner part having means for attachment to a container, and a support element between the top walls resisting axial movement of the inner part top wall toward the outer part top wall, in which the support element is connected by adhesive to the top wall of the inner part and in which a central region of the support element is domed to receive the adhesive.

Still further in accordance with the invention, there is provided a closure for a container comprising an outer part having a top wall and a depending peripheral skirt having inner and outer surfaces, an inner part having a top wall and a depending peripheral skirt having inner and outer surfaces, the inner surface of the skirt of the inner part having means for attachment to a container, and a support element between the top walls resisting axial movement of the inner part top wall formed toward the outer part top wall, in which the outer surface of the skirt of the inner part is connected by adhesive to the inner surface of the skirt of the outer part, and in which the adhesive connects the inner part and a peripheral region of the support element.

The invention may be performed in various ways and some specific embodiments with possible modifications will now be described by way of example with reference to the accompanying drawings, in which.

Figure 1:
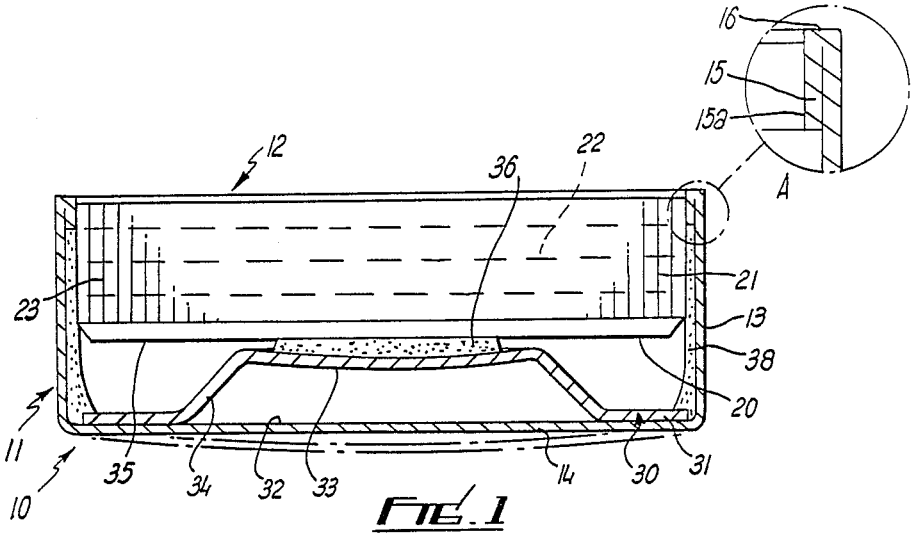
FIG. 1 is a part-section of a container closure.

Referring to FIG. 1 a closure 10 for a container has an outer part 11 and an inner part 12. The outer part 11 is usually of metal e.g. aluminum which may be coloured gold and is pressed from a sheet strip. The outer part 11 has a peripheral side wall or depending skirt 13 and a top wall 14. The bottom edge 15 of the side wall 13 is bent inwards and back onto the wall 13 as shown enlarged at A to give a smooth rounded bottom edge 16 to the wall of the closure 10. The wall 13 is thus of substantially double thickness in its bottom region (top in the drawing).

The wall 14 may be flat or have a decorative shape e.g. be slightly domed as indicated in chain line.

The inner part 12 may be metal but is typically of moulded plastics having a top wall 20 and a peripheral side wall or depending skirt 21. The inner surface of side wall 21 is typically threaded as indicated schematically at 22 so that the closure 10 can be threaded onto the top of a container.

The outer surface 23 of the part 12 may be knurled, for example by axial grooves and ribs 23 as shown. The inner part 12 is a firm push fit in the bent-in edge 15.

A spacing and support element 30 has a flat rim 31 engaging the inner surface 32 of the top 14 and has a central domed region 33 connected to the rim by inclined portion 34 or other supporting form. The region 33 may abut the outer top face 35 of the top wall 20 but preferably as shown adhesive 36 located in the region 33 secures the inner part to the element 30. The inner surface 37 of the side wall 13 is provided with a coating 38 of adhesive so that the annular gap between walls 13, 21 is filled with adhesive to hold the side walls against relative movement. In some cases the inner surface **15*a* in region 15 may also be coated with adhesive. Preferably the adhesive 38 extends to the outer edge of the rim 31 to further secure the element 30. In some cases the adhesive 38, applied for example by spraying, fills the gap between the outer edge of rim 31 and the inner surface of the outer part 11**.

The adhesive 38, 36 assists in resisting relative movement between the inner and outer parts.

The element 30 substantially prevents axial movement of the inner part 13 relative to the outer part 11.

Figure 2:
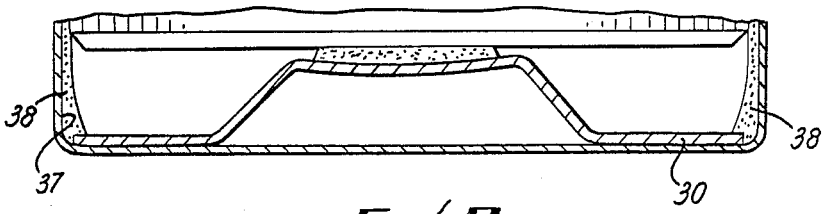
FIG. 2 is similar to FIG. 1 showing part of another closure.
Figure 3:
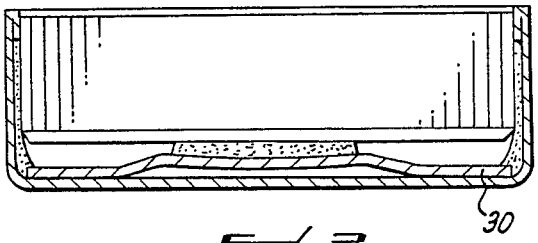
FIG. 3 is similar to FIG. 1 showing a further closure.

FIGS. 2 and 3 show similar arrangements in which the support element 30 takes different forms.

If the outer part 11 is to be used with an inner part of different axial depth, then the element 30 is selected to have the appropirate depth. Use of different elements 30 thus enables the same outer part to be used with different inner parts.

The adhesive 38 extends completely around the surface 37.

I claim:

1. A closure for a container comprising an outer part having a top wall and a depending peripheral skirt having inner and outer surfaces, and inner part having a top wall and a depending peripheral skirt having inner and outer surfaces, the inner surface of the skirt of the inner part having means for attachment to a container, and a separately formed support element between the top walls spacing the walls from each other so as to leave open spaces therebetween and resisting axial movement of the inner part top wall towards the outer part top wall.

2. A closure as claimed in claim 1, in which the support element is connected by adhesive to the top wall of the inner part.

3. A closure as claimed in claim 2, in which said support element is wholly confined between said top walls, and means are provided connecting a peripheral region of the support element to the outer part to resist rotation of the support element relative to the outer part.

4. A closure as claimed in claim 3, in which the connecting means comprises adhesive.

5. A closure as claimed in claim 1, in which the outer surface of the skirt of the inner part is connected by adhesive to the inner surface of the skirt of the outer part.

6. A closure as claimed in claim 5, in which the adhesive extends around the outer surface.

7. A closure as claimed in claim 1, in which a bottom edge of the skirt of the outer part is folded in to provide a region of increased skirt thickness with respect to an axially adjacent skirt portion, the inner part being a push fit in the region of increased skirt thickness.

8. A closure for a container comprising an outer part having a top wall and a depending peripheral skirt having inner and outer surfaces, an inner part having a top wall and a depending peripheral skirt having inner and outer surfaces, the inner surface of the skirt of the inner part having means for attachment to a container, and a support element between the top walls resisting axial movement of the inner part top wall toward the outer part top wall, in which the support element is connected by adhesive to the top wall of the inner part and in which a central region of the support element is domed to receive the adhesive.

9. A closure for a container comprising an outer part having a top wall and a depending peripheral skirt having inner and outer surfaces, an inner part having a top wall and a depending peripheral skirt having inner and outer surfaces, the inner surface of the skirt of the inner part having means for attachment to a container, and a support element between the top walls resisting axial movement of the inner part top wall toward the outer part top wall, in which the outer surface of the skirt of the inner part is connected by adhesive to the inner surface of the skirt of the outer part, and in which the adhesive connects the inner part and a peripheral region of the support element.

* * * * *